US006032559A

United States Patent [19]

Dean, Jr.

[11] Patent Number: 6,032,559

[45] Date of Patent: Mar. 7, 2000

[54] FILL RISER COLD PUNCH

[76] Inventor: William R. Dean, Jr., 2414 Ralph St., Houston, Tex. 77006-2427

[21] Appl. No.: 08/948,111

[22] Filed: Oct. 9, 1997

[51] Int. Cl.[7] ..... B23D 21/14

[52] U.S. Cl. ..... 83/191; 83/178; 83/54; 83/613; 83/639.2

[58] Field of Search ..... 83/54, 178, 188, 83/191, 613, 639.1, 639.2, 684–86

[56] References Cited

U.S. PATENT DOCUMENTS

| | | | |
|---|---|---|---|
| 2,736,949 | 3/1956 | Kraemer . | |
| 3,271,988 | 9/1966 | Klinksiek | 83/54 X |
| 3,802,310 | 4/1974 | Maurer | 83/527 |
| 3,915,044 | 10/1975 | Bley | 83/639 |
| 4,043,236 | 8/1977 | De Jong | 83/639 X |
| 4,087,912 | 5/1978 | Granone . | |
| 4,096,727 | 6/1978 | Gargaillo | 83/639 X |
| 4,399,829 | 8/1983 | Schuler . | |
| 4,534,250 | 8/1985 | Garrocho | 83/639 X |
| 4,597,180 | 7/1986 | Allen . | |
| 4,631,996 | 12/1986 | Magnuson | 83/639 X |
| 4,763,550 | 8/1988 | Waltonen et al. | 83/639 X |
| 4,765,173 | 8/1988 | Schellstede . | |
| 4,832,069 | 5/1989 | Gale et al. . | |
| 4,936,013 | 6/1990 | Sahawneh . | |
| 4,956,916 | 9/1990 | Robertson . | |
| 5,044,388 | 9/1991 | Barton et al. . | |
| 5,233,749 | 8/1993 | Saito et al. | 83/639.1 X |
| 5,699,708 | 12/1997 | Deni et al. | 83/180 |
| 5,784,920 | 7/1998 | Kadis | 83/639.1 X |
| 5,829,299 | 11/1998 | Wessels | 72/327 |

*Primary Examiner*—Rinaldi I. Rada
*Assistant Examiner*—T. Anthony Vaughn
*Attorney, Agent, or Firm*—Keeling Law Firm

[57] ABSTRACT

A pipe punch apparatus which generally comprises a punch housing, a punch means situated within the punch housing, and a collar. The punch housing is connected to a bi-directional hydraulic fluid pump means. Depending on which direction the pump is set, the pump releases fluid into the punch housing which causes the punch means to either extend from the punch housing or retract into the punch housing. The collar is connected to the punch housing by a connecting means so that a notch within the collar receives the punch means when the punch means is in the extended position. The parts are also relatively situated so that positioning the punch housing within a pipe will cause the collar to be located exterior to the pipe. Thus, as the punch means moves from its initial retracted position to its extended position, it will also punch a hole through the pipe. Because the build up of hydraulic pressure which causes the punch means to move is gradual, no friction or heat, or only a negligible amount, is generated by the punching action. Functionally applying the pipe punch apparatus discloses a method for punching holes in pipes.

14 Claims, 4 Drawing Sheets

FILL RISER COLD PUNCH

BACKGROUND OF THE INVENTION

1. Field of Invention.

This invention relates generally to devices and methods for producing holes in metal piping. More specifically, this invention relates to devices and methods for safely producing holes in gasoline tank fill pipes.

2. Related Art.

Large underground fuel tanks, such as those used at gasoline filling stations, typically have a metal tank fill pipe extending from ground level to a top end of the tank. Generally, the fuel tanks contain both fuel and water.

Operators utilize a variety of sensors to keep track of certain key characteristics of the tank and its contents. Such characteristics may include the level of the fuel, the level of the water, and the temperature of the tank. Many of these sensors are electronic, transmitting their signal to an instrumentation housing and then to a display device.

Presently, the majority of the sensors and the electrical wiring required to transmit the information to the sensor display device are installed through an unused bung on the top of the tank. Installation of a sensor in an unused bung requires a disinterring of the tank and subsequent repair of the surface. Disinterring the tank is both expensive and disruptive.

A second method of mounting the sensor and associated electrical wiring is to install the sensor through the tank fill pipe. In order to install the sensor through the fill pipe, a hole must normally first be made through the fill pipe. Because the installation of a sensor is usually performed after the gasoline tank is in use, the hole is normally made through the fill pipe with the tank already holding gasoline. Therefore, great care must be taken when making the hole to avoid creation of a spark which could ignite the gasoline in the tank.

Unfortunately, it is common for people in the field to use electric drills to create the hole through the fill pipe. The use of an electric drill causes friction which can create a spark or raise the temperature in the tank. Such a process poses great danger to people and property as it could result in igniting the gasoline in the tank.

It would thus be a great benefit to invent an apparatus or method which creates a hole in the fill pipe of an at least partially filled gasoline tank without generating friction.

SUMMARY OF THE INVENTION

Accordingly, the objectives of this invention are to provide, inter alia, an apparatus and method that:

- creates a hole in the fill pipe of an at least partially filled gasoline tank without generating friction;
- provides for the safe installation of sensors to existing underground gasoline tanks; and
- allows installation of sensors to existing underground gasoline tanks without a disinterring of the tank or site excavation.

To achieve such improvements, my invention is a pipe punch apparatus which generally comprises a punch housing, a punch means situated within the punch housing, and a collar. The punch housing is connected to a bi-directional hydraulic fluid pump means. Depending on which direction the pump is set, the pump releases fluid into the punch housing which causes the punch means to either extend from the punch housing or retract into the punch housing. The collar is connected to the punch housing by a connecting means so that a notch within the collar receives the punch means when the punch means is in the extended position. The parts are also relatively situated so that positioning the punch housing within a pipe will cause the collar to be located exterior to the pipe. Thus, as the punch means moves from its initial retracted position to its extended position, it will also punch a hole through the pipe. Because the build up of hydraulic pressure which causes the punch means to move is gradual, no friction or heat, or only a negligible amount, is generated by the punching action. Functionally applying the pipe punch apparatus discloses a method for punching holes in pipes.

DETAILED DESCRIPTION OF THE INVENTION

The preferred embodiment of my invention is shown in FIGS. 1 through 10 and pipe punch apparatus is depicted as 10. The pipe punch apparatus 10 is used to punch holes in fill riser pipes, such as the pipe depicted as 300.

Figure 1:
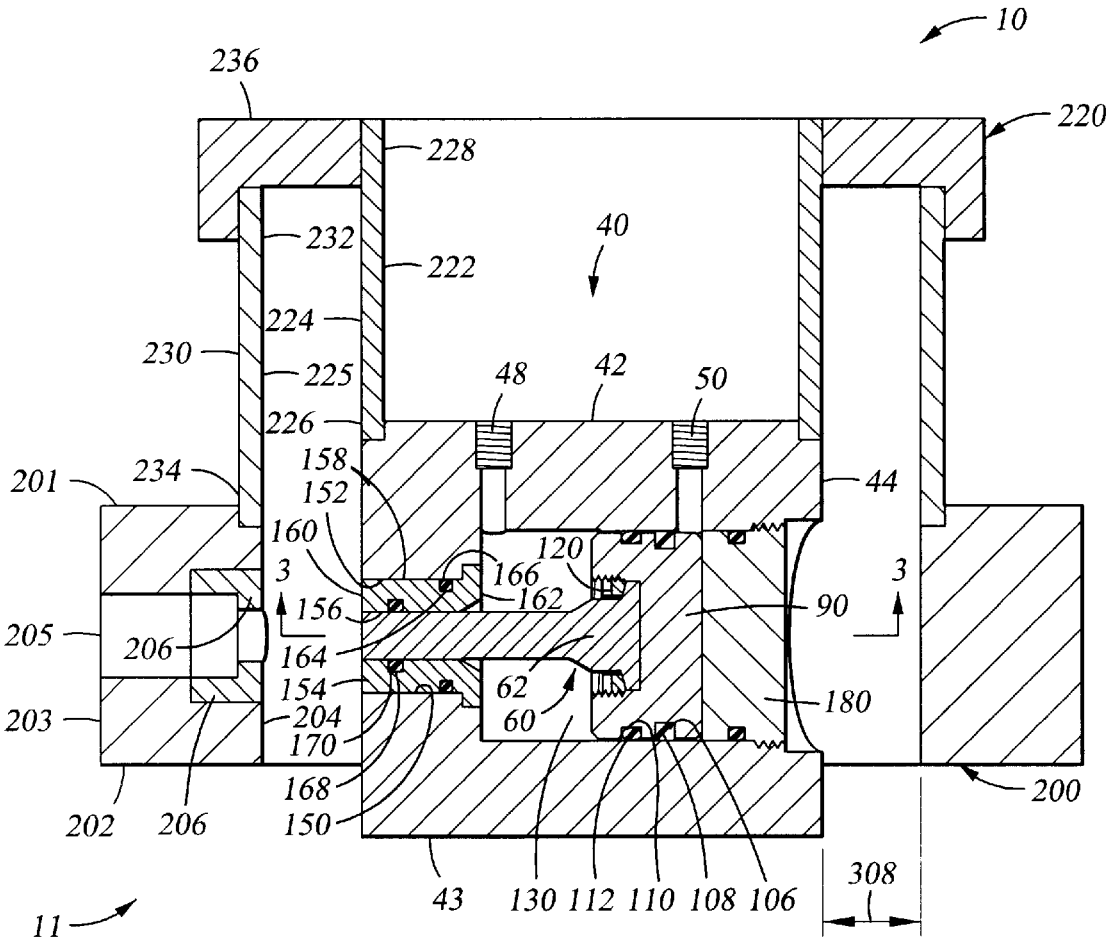
FIG. 1 is an elevational cross-sectional view of the pipe punch apparatus in the retracted position being inserted into a pipe without being connected to the pump means.
Figure 1:
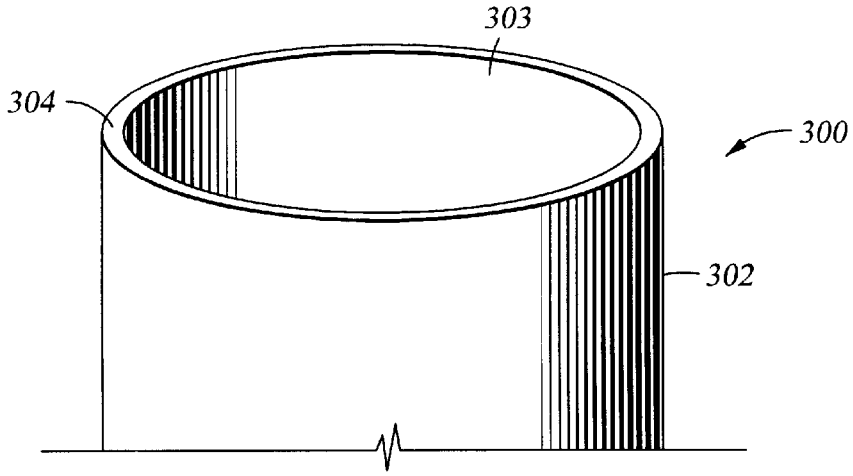

As shown in FIG. 1, pipe 300 includes a pipe inner surface 303, a pipe outer surface 302, and a pipe top surface 304.

Figure 2:
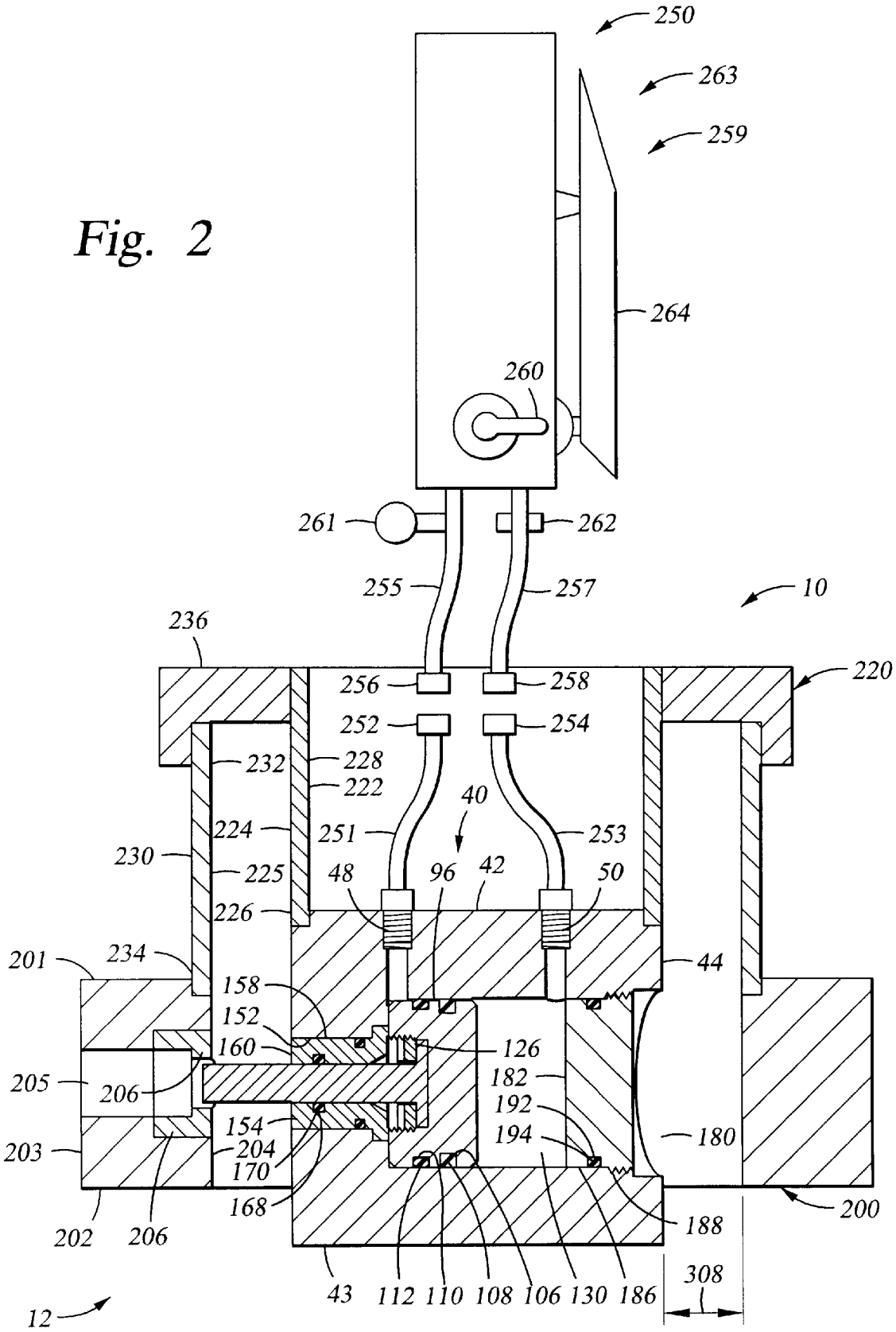
FIG. 2 is an elevational cross-sectional view of the pipe punch apparatus in the extended position connected to the pump means.

Generally, as shown in FIGS. 1 and 2, the pipe punch apparatus 10 comprises a punch housing 40, a punch means 60, a collar 200, a connecting means 220, and a pump means 250 (not shown in FIG. 1 but shown in FIG. 2).

In a preferred embodiment, punch housing 40 is cylindrical in shape. Punch housing 40 is constructed of a rigid material, such as tool steel.

Punch housing 40 includes a circular housing top surface 42, a circular housing bottom surface 43, and a housing outer wall 44 comprising the wall of the cylindrical shape. Punch housing 40 comprises a front portion 45 and a rear portion 46 (as best shown in FIGS. 4–7). A dashed line 47 at FIGS. 4–7 designates a diameter location representing the division of punch housing 40 between the front portion 45 and the rear portion 46. The diameter of punch housing 40 is, at least, slightly smaller than the diameter of pipe inner surface 303.

Figure 7:
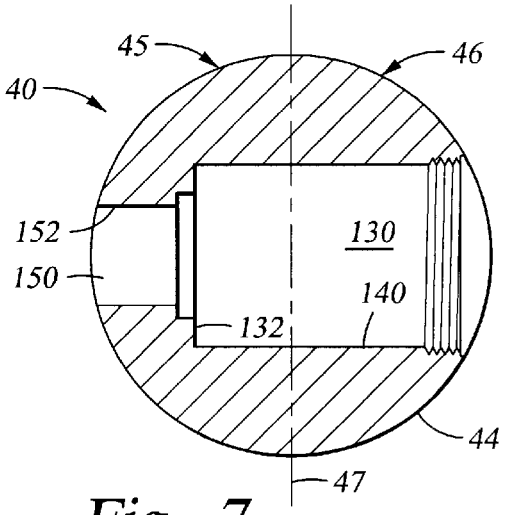
FIG. 7 is a cross-sectional view of the punch housing along line 7—7 of FIG. 6 without any mechanisms therein.
Figure 5:
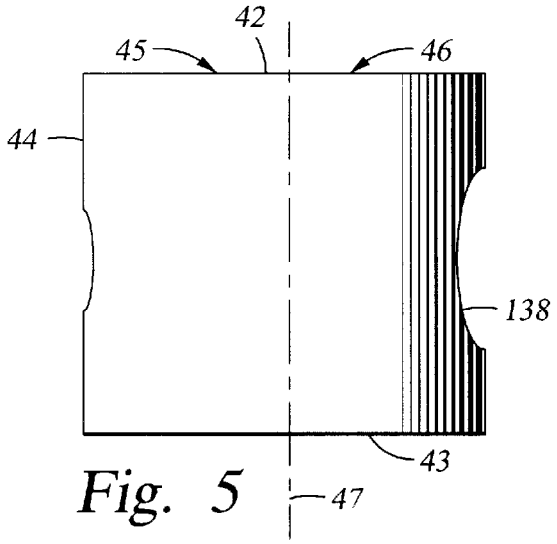
FIG. 5 is a side view of the punch housing.
Figure 8:
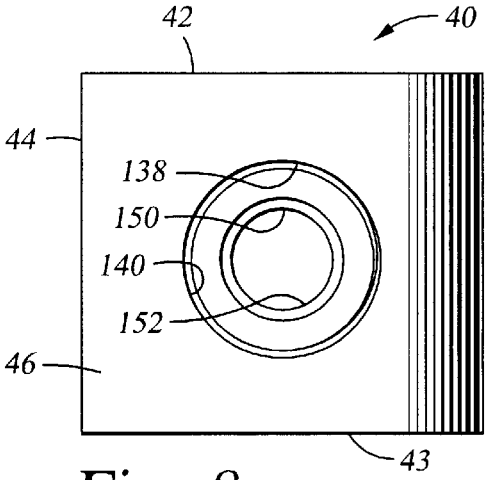
FIG. 8 is an elevational view of the rear portion of the punch housing without any mechanisms therein.
Figure 6:
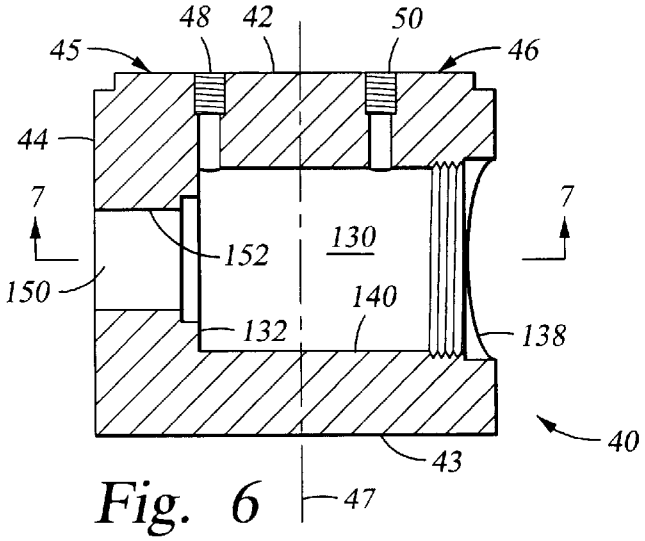
FIG. 6 is a cross-sectional view of the punch housing along line 6—6 of FIG. 4 without any mechanisms therein.

As best shown in FIGS. 6–8, punch housing 40 includes a cylindrical chamber 130 which extends through the housing outer wall 44 of rear portion 46 and partially into front portion 45 up to circular chamber front surface 132. The circular chamber front surface 132 and the circular opening 138 on outer wall 44 define the circular sections of cylindrical chamber 130. In a preferred embodiment, chamber 130 is located substantially between housing top surface 42 and housing bottom surface 43 and is defined therein by chamber inner surface 140, chamber front surface 132, and circular opening 138.

Punch housing 40 also includes an aperture 150 in the front portion 45. In the preferred embodiment as shown in FIG. 8, the cross section of aperture 150 is circular in shape. Aperture 150 is defined by chamber aperture wall 152 and extends from chamber front surface 132 towards and through the housing outer wall 44 of front portion 45. Aperture 150 is located substantially concentric with cylindrical chamber 130.

In an alternative embodiment, as shown in FIGS. 1 and 2, aperture 150 is lined with a bushing 154. Bushing 154 acts as a guide to punch 62, once punch 62 is positioned within punch housing 40 as will be disclosed herein. In a preferred embodiment of bushing 154, bushing 154 is fabricated of bronze.

Figure 10:
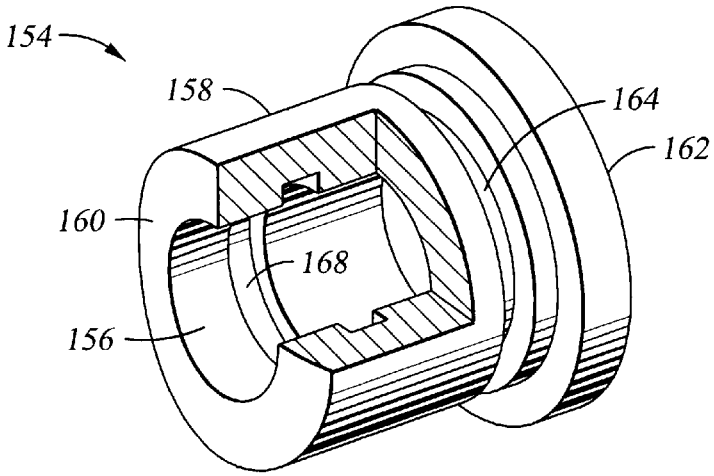
FIG. 10 is a partial cut-away isometric view of the bushing.
Figure 4:
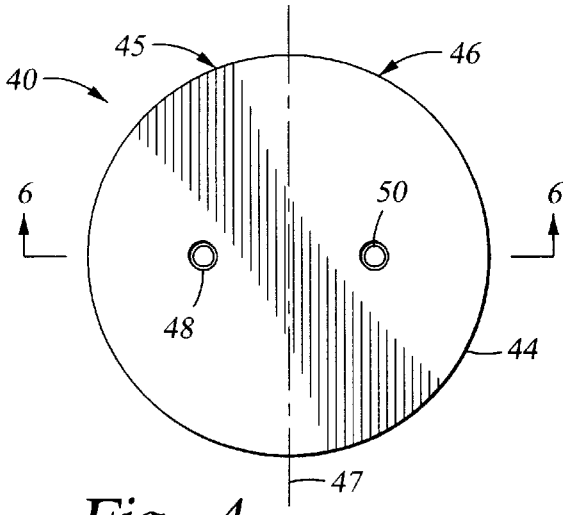
FIG. 4 is a top view of the punch housing.

As shown in FIG. 10, bushing 154 includes a bushing inside surface 156, a bushing outside surface 158, a bushing front surface 160, and a bushing rear surface 162. Bushing outside surface 158 abuts and is connected to chamber aperture wall 152 by press-fitting. With bushing 154 lining aperture 150, bushing inside surface 156 defines aperture 150 and acts as a guide to punch 62, once punch 62 is positioned within punch housing 40 as will be disclosed herein. Necessarily, the circular cross-section defined by bushing inside surface 156 has at least a slightly larger diameter than the cross-sectional diameter of the portion of punch 62 which fits therein (punch free section 64). Bushing front surface 160 is flush with the outer wall 44 of housing front portion 45. Bushing rear surface 162 is adjacent chamber front surface 132.

Bushing outside surface 158 includes a first seal groove 164 and a first seal 166. First seal 166 fits within first seal groove 164 and is preferably an o-ring seal that provides a seal between bushing outside surface 158 and chamber aperture wall 152.

Bushing inside surface 156 includes a second seal groove 168 and a second seal 170. Second seal 170 fits within second seal groove 168 and is preferably an o-ring seal that provides a seal between bushing inside surface 156 and a punch free section 64, once punch 62 is positioned within punch housing 40 as will be disclosed herein.

Punch housing 40 also includes a first port 48 and a second port 50. First and second ports, 48 and 50, extend from chamber inner surface 140 toward and through housing top surface 42. First port 48 is vertically adjacent to chamber front surface 132.

Preferably, the edge of first port 48 distal rear portion 46 is flush with chamber front surface 132. Second port 50 is located between first port 48 and the housing outer wall 44 of rear portion 46. In a preferred embodiment, first and second port, 48 and 50, are located vertically above cylindrical chamber 130.

Punch housing 40 includes a punch means 60 located in chamber 130. In a preferred embodiment, punch means 60 comprises a punch 62, a punch holder 90, a punch attachment means 71, and a cap 180.

Figure 3:
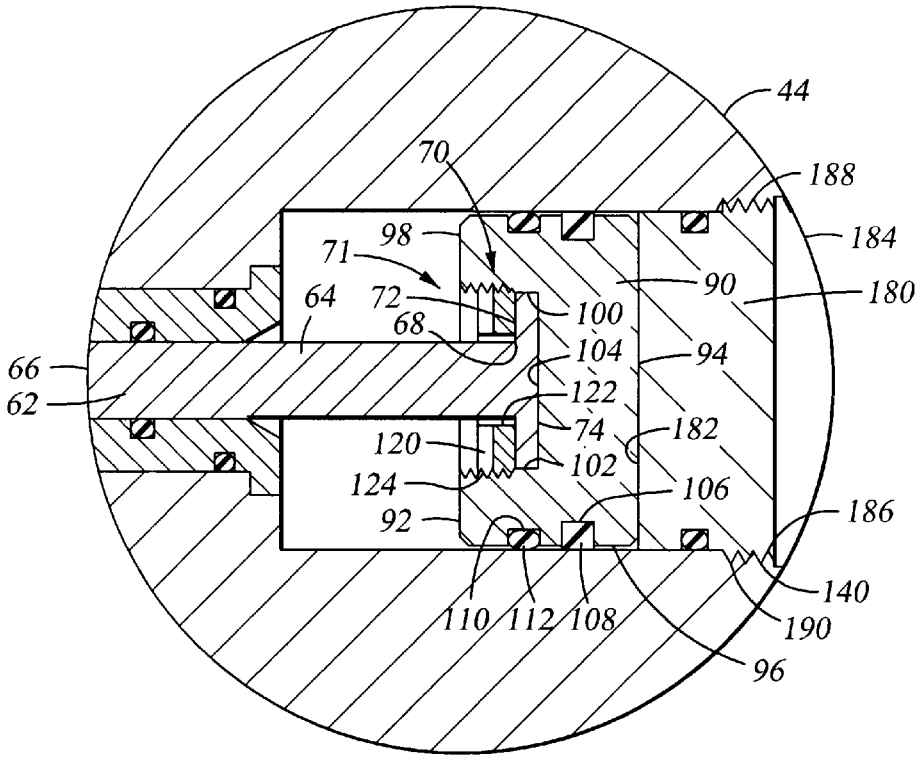
FIG. 3 is a top cross-sectional view of the punch housing along line 3—3 of FIG. 1 including a different embodiment of the punch.

As best shown in FIGS. 2 and 3, cap 180 includes a cap inner surface 182, a cap outer surface 184, and a cap mating surface 186. Cap 180 is cylindrical in shape so that cap inner surface 182 and cap outer surface 184 are circular in shape.

Cap 180 is positioned within chamber 130. Cap inner surface 182 is vertically adjacent the edge of second port 50 which is distal front portion 45. Preferably, the edge of second portion 45 is flush with cap inner surface 182. Cap outer surface 184 extends substantially to the housing outer wall 44 of rear portion 46. In a preferred embodiment, cap outer surface 184 is flush with housing outer wall 44 of rear portion 46 thereby covering circular opening 138. Cap outer surface 184 may not extend past housing outer wall 44 of rear portion 46.

Cap mating surface 186 abuts and is selectively attached to chamber inner surface 140. Cap attachment means 190 securely and selectively attaches cap 180 in chamber 130 to chamber inner surface 140. In a preferred embodiment, cap attachment means 190 preferably comprises matching cooperative threading 188 on cap mating surface 186 and on the corresponding portion of chamber inner surface 140. Preferably, at least a segment of cap mating surface 186 adjacent cap inner surface 182 does not include cooperative threading 188.

In essence, cap 180 functions as a plug of chamber 130, providing a partition between chamber 130 and the exterior of punch housing 40. Thus, chamber 130 is further constricted and defined by the inner surface 182 of cap 180.

Cap 180 also includes a third seal groove 192 and a third seal 194. Third seal groove 192 is located on cap mating surface 186 relatively close to cap inner surface 182, or at least between cap inner surface 182 and threading 188. Third seal 192 fits within third seal groove 194 and is preferably an o-ring seal that provides a seal between cap 180 and chamber 130.

As shown in FIGS. 1–3, punch 62 and punch holder 90 are contained within chamber 130. Punch holder 90 includes a punch holder front surface 92, a punch holder rear surface 94, and a punch holder sliding surface 96. Punch holder 90 is cylindrical in shape so that punch holder front surface 92 and punch holder rear surface 94 are both also circular. Punch holder sliding surface 96, in this embodiment, abuts chamber inner surface 140 and comprises the wall of the cylindrical shape. In addition, the punch holder 90 extends partially between the inner surface 182 of cap 180 and the chamber front surface 132 so that punch holder rear surface 94 is proximal cap inner surface 182 and punch holder front surface 92 is proximal chamber front surface 132.

Punch holder 90 also includes a fourth seal groove 110, a fourth seal 112, a wear band groove 106, and a wear band 108. Fourth seal groove 110 is located on punch holder sliding surface 96. Fourth seal 112 fits within fourth seal groove 110 and is preferably an o-ring seal that provides a seal between punch holder 90 and chamber 130. Wear band groove 106 is located on punch holder sliding surface 96 between fourth seal groove 110 and punch holder rear surface 94. Wear band 108 fits within wear band groove 106 and guides and supports punch holder 90 as it slides within chamber 130. Thus, wear band 108 also prevents the creation of friction as punch holder 90 slides within chamber 130. Wear band 108 is constructed from suitable material such as phenolic.

Further, punch holder 90 is capable of sliding within chamber 130 between the inner surface 182 of cap 180 and the chamber front surface 132 when hydraulic fluid pressure is applied to either the punch holder front surface 92 or the punch holder rear surface 94. In order to facilitate sliding, chamber inner surface 140 is polished, and any surface inconsistencies are removed.

Punch 62 includes a punch free section 64 and a punch attachment section 70. In a preferred embodiment, punch 62 has a circular cross-section.

Punch free section 64 generally comprises a long and relatively thin cylinder having a free section first end 66 and a free section second end 68. Punch free section 64 is fixedly attached to punch attachment section 70 at free section second end 68.

As best shown in FIGS. 2 and 3, punch attachment section 70 generally comprises a short and relatively thick cylinder having an attachment section first end 72 and an attachment section second end 74. Punch free section 64 and punch attachment section 70 are connected at attachment section first end 72. The diameter of a cross-section of punch attachment section 70 is preferably larger than the diameter of a cross-section of punch free section 64.

Figure 9:
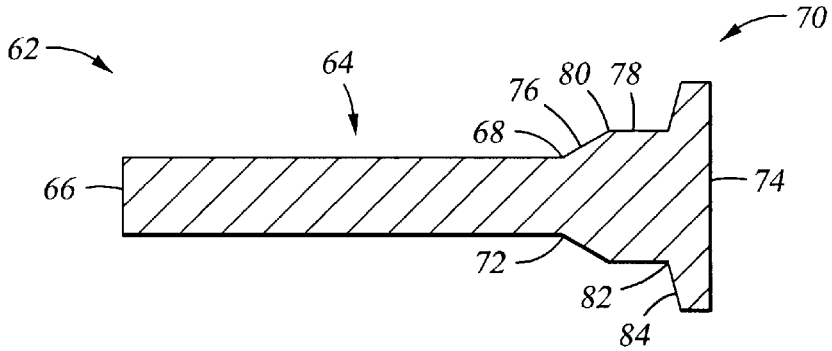
FIG. 9 is a side view of one embodiment of the punch.

In the alternative preferred embodiment shown in FIGS. 1 and 9, punch attachment section 70 includes an attachment section first end 72, an attachment section first taper 76, an attachment section middle 78, an attachment section second taper 84, and an attachment section second end 74. Attachment section middle 78 includes a middle first end 80 and a middle second end 82.

In this alternative preferred embodiment shown in FIGS. 1 and 9, punch free section second end 68 is connected to punch attachment section first end 72. Attachment section first end 72 is then connected to the first end 80 of attachment section middle 78 by attachment section first taper 76. Attachment section first taper 76 gradually increases the cross-sectional diameter of punch attachment section 70 so that the cross-sectional diameter at attachment section middle 78 is greater than the cross-sectional diameter at attachment section first end 72. The cross-sectional diameter of attachment section middle 78 is uniform. The second end 82 of attachment section middle 78 is connected to the attachment section second end 74 by attachment section second taper 84. Attachment section second taper 84 gradually increases the cross-sectional diameter of punch attachment section 70 so that the cross-sectional diameter at attachment section second end 74 is greater than the cross-sectional diameter of attachment section middle 78.

In a preferred embodiment, punch free section 64 and punch attachment section 70 (in either embodiment) comprise one integral unit.

Punch 62 is attached to punch holder front surface 92 at punch attachment section 70 by punch attachment means 71 (see FIG. 3). In a preferred embodiment, punch attachment means 71 comprises a nut 120 and a bore 100 within punch holder 90.

Nut 120 has a nut inner surface 122 and a nut outer surface 124. Nut outer surface 124 contains axial threading.

In the embodiment with nut 120, bore 100 extends within punch holder 90 through punch holder front surface 92 and partially into punch holder 90. Bore 100 is defined within punch holder 90 by a bore inner surface 102 and a bore rear surface 104 (see FIG. 2). Bore inner surface 102 contains axial threading at least partially starting at the punch holder front surface 92 and extending towards the bore rear surface 104. Bore 100 is sized so that the axial threading of bore inner surface 102 cooperatively engages the axial threading of nut outer surface 124 and is sized to receive punch attachment section 70 therein.

As shown in FIGS. 2 and 3, in the embodiment not including attachment section first and second taper, 76 and 84, nut 120 is sized so that punch free section 64 is inserted into nut 120. Preferably, the cross-sectional diameter of punch free section 64 is slightly smaller than the cross-sectional diameter of nut inner surface 122. To assemble, attachment section second end 74 is placed within bore 100 so that it abuts bore rear surface 104. Nut 120 is then placed and slid on punch free section 64. The threading of nut outer surface 124 is then cooperatively engaged to the threading of bore inner surface 102. It should be noted that the relative lengths of bore 100, punch free section 64, and punch attachment section 70 are sized so that when punch attachment section 70 is in place within bore 100, nut 120 abuts against attachment section first end 72 and concurrently engages the threading of bore inner surface 102. Thereby, nut 120 securely binds punch 62 to punch holder 90.

As shown in FIG. 1, in the embodiment including attachment section first and second taper, 76 and 84, nut 120 is sized so that nut inner surface 122 engages attachment section middle 78. To assemble, attachment section second end 74 is placed within bore 100 so that it abuts bore rear surface 104. Preferably, the cross-sectional diameter of attachment section middle 78 is slightly smaller than the cross-sectional diameter of nut inner surface 122. Nut 120 is then placed and slid on punch free section 64. Because the cross-sectional diameter of attachment section middle 78 is larger than that of punch free section 64 and attachment section first end 72, nut 120 slides on punch free section 64 and attachment section first end 72 until reaching attachment section middle 78. The threading of nut outer surface 124 is then cooperatively engaged to the threading of bore inner surface 102. It should be noted that the relative lengths of bore 100, punch free section 64, and punch attachment section 70 are sized so that when punch attachment section 70 is in place within bore 100, nut 120 abuts against attachment section second taper 84 and concurrently engages the threading of bore inner surface 102. In this embodiment, it is preferable that nut 120 have an angular notch 126 cut from the corresponding side of nut inner surface 122 so that nut 120 cooperatively abuts and engages attachment section second taper 84. Thereby, nut 120 securely binds punch 62 to punch holder 90.

Punch 62 is attached to punch holder front surface 92 so that punch free section first end 66 extends into aperture 150. Thus, the cross-sectional diameter of punch free section 64 is smaller than the cross-sectional diameter of aperture 150 (or bushing inside surface 156 in the relevant embodiment). When punch holder rear surface 94 abuts the inner surface 182 of cap 180, it is imperative that punch free section first end 66 does not extend into aperture 150 through housing outer wall 44. In a preferred embodiment, when punch holder rear surface 94 abuts the inner surface 182 of cap 180, punch free section first end 66 extends into aperture 150 up to housing outer wall 44. Thus, in the preferred embodiment, punch free section first end 66 is flush with housing outer wall 44 when punch holder rear surface 94 abuts the inner surface 182 of cap 180.

As best shown in FIG. 1, connecting means 220 connects punch housing 40 to collar 200. In a preferred embodiment, connecting means 220 comprises an inner cylinder 222, an outer cylinder 230, and a connecting ring 236.

Inner cylinder 222 includes a first end 226 and a second end 228. Inner cylinder 222 is attached to the housing top surface 42 at its first end 226 so that the first and second ports, 48 and 50, are located within the inner cylinder 222. In a preferred embodiment, inner cylinder 222 is attached to the housing top surface 42 at its first end 226 so that the outer surface 224 of inner cylinder 222 is flush with and parallel to the housing outer wall 44. Inner cylinder 222 is attached to housing top surface 42 by ordinary attachment means, such as fasteners.

Inner cylinder 222 extends upward from housing top surface 42 towards its second end 228. At its second end 228, inner cylinder 222 is attached to connecting ring 236. Inner cylinder 222 is attached to connecting ring 236 by ordinary attachment means, such as fasteners.

Connecting ring 236 connects inner cylinder 222 to outer cylinder 230. In the preferred embodiment, inner cylinder 222 is concentric with outer cylinder 230. In its preferred embodiment, connecting ring 236 is annular in shape, has an L-shaped cross section, and extends outwardly in the radial direction from inner cylinder 222. Connecting ring 236 is connected to the second end 228 of inner cylinder 222 and to a first end 232 of outer cylinder 230.

Outer cylinder 230 includes a first end 232 and a second end 234. Outer cylinder 230 is attached at its first end 232 to connecting ring 236 and extends downward from connecting ring 236 towards its second end 234. Outer cylinder 230 is attached at its second end 234 to collar 200. Outer cylinder 230 is attached to connecting ring 236 by ordinary attachment means, such as fasteners.

It is noted that the cross-sectional diameter of outer cylinder 230 is larger than the cross-sectional diameter of inner cylinder 222. Thus, a radial distance 308 is defined between outer cylinder 230 and inner cylinder 222.

Collar 200 is annular in shape and preferably has a rectangular cross-section. Collar 200 includes a top surface 201, a bottom surface 202, an outer surface 203, and an inner surface 204. Collar 200 is attached on its top surface 201 to outer cylinder 230 so that the inside surface 225 of outer cylinder 230 is flush with collar inner surface 204. Thus, in the preferred embodiment, the radial distance 308 is also defined between collar inner surface 204 and housing outer wall 44.

At least a portion of collar 200 must be located substantially between housing top surface 42 and housing bottom surface 43. In the preferred embodiment, collar 200 in its entirety is located substantially between housing top surface 42 and housing bottom surface 43.

Collar 200 includes a notch 205. Notch 205 extends through collar inner surface 204 and through collar outer surface 203. Notch 205 is located so that it is in the same radial direction and in the same horizontal plane as aperture 150 of punch housing 40. In a preferred embodiment, notch 205 is located substantially between collar top surface 201 and collar bottom surface 202 and has a circular cross-section.

Adjacent collar inner surface 204, notch 205 is lined with a die 206. Die 206 is press fitted within notch 205 and, in a preferred embodiment, provides notch 205 with a circular cross-section at collar inner surface 204. However, regardless of its shape, the smallest cross-sectional length provided by die 206 on collar inner surface 204 must be at least slightly larger than the cross-section of punch free section 64. Die 206 is constructed of materials comprising normal punching die tooling materials. Such materials are commonly known in the art.

It must be noted that connecting means 220 connects outer collar 200 and punch housing 40 so that the radial distance 308 between housing outer wall 44 and collar inner surface 204 is, at least, slightly larger than the radial thickness of pipe top surface 304. Preferably, the radial distance 308 between housing outer wall 44 and collar inner surface 204 is only slightly larger than the radial thickness of pipe top surface 304.

As previously disclosed, punch means 60 slides within chamber 130 between cap inner surface 182 and chamber front surface 132 as a response to hydraulic fluid pressure applied to either punch holder front surface 92 or punch holder rear surface 94. This motion defines two positions for punch means 60: a retracted position 11 (FIGS. 1 and 3) and an extended position 12 (FIG. 2).

In the retracted position 11, punch free section 64 is retracted within punch housing 40 into aperture 150 and punch holder rear surface 94 preferably abuts cap inner surface 182. In essence, punch free section 64 is not extended out of aperture 150 and punch housing 40.

In the extended position 12, punch free section 64 is extended out of punch housing 40 and aperture 150. In the extended position 12, punch free section 64 must extend well into notch 205 of collar 200. Thus, punch free section 64 and radial distance 308 must be accordingly sized and constructed. In the extended position 12, punch holder front surface 92 may abut chamber front surface 132 depending on the length of punch means 60 extension.

As shown in FIG. 2, pump means 250 comprises a pump 259, a first hose and coupling, 251 and 252, a second hose and coupling, 253 and 254, a third hose and coupling, 255 and 256, and a fourth hose and coupling, 257 and 258.

First hose 251 is connected to and in fluid communication with first port 48 by means commonly known in the art. At the end distal to first port 48, first hose 251 is connected to and in fluid communication with first coupling 252. Likewise, second hose 253 is connected to and in fluid communication with second port 50 by means commonly known in the art. At the end distal to second port 50, second hose 253 is connected to and in fluid communication with second coupling 254.

Third hose 255 is connected to and in fluid communication with third coupling 256 at one end, and is connected to and in fluid communication with pump 251 at its other end. Fourth hose 257 is connected to and in fluid communication with fourth coupling 258 at one end, and is connected to and in fluid communication with pump 251 at its other end.

In turn, third coupling 256 is constructed to selectively and removably mate with first coupling 252. Thus, third coupling 256 is connected to and in fluid communication with first coupling 252. Likewise, fourth coupling 258 is constructed to selectively and removably mate with second coupling 254. Thus, fourth coupling 258 is connected to and in fluid communication with second coupling 254.

First hose and coupling, 251 and 252, second hose and coupling, 253 and 254, third hose and coupling, 255 and 256, and fourth hose and coupling, 257 and 258, are all items which may be purchased "off the shelf." Their existence and respective connections are all well-known to a person with ordinary skill in the art.

Pump 259 is preferably a bi-directional hydraulic fluid pump. Pump 259 includes a pump direction lever 260, a pull pressure gauge 261, and a push pressure gauge 262. In a preferred embodiment, pump 259 comprises a hand pump 263 capable of bi-directional pumping (suction and force). Hand pump 263 normally includes a pump arm 264 which provides the activation mechanism of the hand pump 263. Pump direction lever 260 governs the direction in which pump 259 pumps hydraulic fluid and includes a forward, a neutral, and a reverse setting.

Pull pressure gauge 261 measures the amount of pressure applied by pump 259 when pump direction lever 260 is in the reverse direction. Although pull pressure gauge 261 may be attached to first hose 251, pull pressure gauge 261 is preferably attached to third hose 255. Push pressure gauge 262 measures the amount of pressure applied by pump 259 when pump direction lever 260 is in the forward direction. Although push pressure gauge 262 may be attached to second hose 253, push pressure gauge 262 is preferably attached to fourth hose 257.

IN OPERATION

In operation, an operator must first ensure that the pump direction lever 260 of pump 259 is in the neutral position and that pull pressure gauge 261 and push pressure gauge 262 read "0" psi.

Punch housing 40 is then placed within pipe 300. Normally, when punch housing 40 is situated within pipe 300, the pipe punch apparatus 10 is supported by outer collar 200 with outer collar bottom surface 202 resting on the ground. Alternatively, an operator may maintain pipe punch apparatus 10 in place by gripping handles (not shown) which may be provided to the apparatus 10.

Next, an operator must identify the pipe 300 location at which he/she would like to create the hole. This can easily be done by matching, in a radial direction, the desired hole location with the location of the notch 205 on collar outer surface 203.

Once the desired hole location is identified, the operator activates pump means 250. The pump direction lever 260 is first moved to the forward position which releases hydraulic fluid from pump 259 into fourth hose 257. Placing the pump direction lever 260 in the forward position does not release hydraulic fluid into third hose 255.

The pump 259 is then activated. In the preferred embodiment which includes hand pump 263, the pump arm 264 is repeatedly raised and lowered thereby pumping hydraulic fluid into fourth hose 257.

As more hydraulic fluid is released into fourth hose 257, hydraulic fluid entering fourth hose 257 passes through fourth coupling 258, through second coupling 254, through second hose 253, and into second port 50. Eventually, hydraulic fluid will completely fill second port 50 and will begin to enter chamber 130.

In the retracted position 11 (the initial mode), punch holder rear surface 94 abuts the inner surface 182 of cap 180. As hydraulic fluid enters chamber 130 through second port 50, hydraulic fluid begins to surround punch holder rear surface 94 and the rear section of punch holder sliding surface 96. It is understood, however, that the area of chamber 130 receiving hydraulic fluid is defined by fourth seal 112 which seals the junction between punch holder sliding surface 96 and chamber inner surface 140 and by third seal 194 which seals the junction between cap mating surface 186 and chamber inner surface 140.

As more and more hydraulic fluid is pumped into chamber 130, the pressure within chamber 130 increases. As the pressure within chamber 130 increases, punch holder 90 begins to slide within chamber 130 towards chamber front surface 132 and punch free section first end 66 begins to move within aperture 150 towards pipe inner surface 303. Punch means 60 thus moves into the extended position 12. At first, punch holder 90 will easily slide within chamber 130. This ease of movement will cease, however, once punch free section first end 66 touches pipe inner surface 303.

Once punch free section first end 66 touches pipe inner surface 303, the hydraulic pressure must be continually increased. During this time, care must be given to observe the push pressure gauge 262 of pump 259.

When enough pressure has been applied within chamber 130, punch free section first end 66 will burst through pipe inner surface 303 and pipe outer surface 302. At this point in time, the pressure on the push pressure gauge 262 will "break over". The operator must actuate the pump arm 263 of pump 259 once more and then stop pumping hydraulic fluid into chamber 130. Punch means 60 is now in the extended position 12.

It is understood that, in the preferred embodiment, outer collar 200 is substantially close to pipe outer surface 203 and that notch 205 of outer collar 200 is located in the same radial direction and horizontal plane as aperture 150. Thus, outer collar 200, and more specifically die 206 of outer collar 200, facilitate and provide support to pipe 300 and punch 62 as punch 62 bursts through pipe 300 and as punch means 60 moves into the extended position 12.

Because notch 205 of outer collar 200 is located in the same radial direction and horizontal plane as aperture 150 of punch housing 40, once punch free section first end 66 bursts through pipe 300, punch free section first end 66 extends partially into notch 205. As punch free section first end 66 extends into notch 205, it will also push and deposit the piece of pipe 300 which was punched into notch 205. It is understood that the shape of the broken piece of pipe 300 substantially corresponds to the shape of punch free section first end 66 and die 206.

Because the pressure buildup within chamber 130 and against pipe inner surface 303 is gradual and because no rotating devices (such as drill bits) are used to create the hole, only a minimal amount of heat or friction, if any at all, is generated by apparatus 10 in creating the hole on pipe 300.

At this time, the operator should place the pump direction lever 260 in the neutral position and then in the reverse position. Placing pump direction lever 260 in the reverse position releases hydraulic fluid from pump 259 into third hose 255. Placing the pump direction lever 260 in the reverse position does not release hydraulic fluid into fourth hose 257.

The pump 259 is then activated. In the preferred embodiment which includes hand pump 263, the pump arm 264 is repeatedly raised and lowered which pumps more hydraulic fluid into third hose 255.

As more hydraulic fluid is released into third hose 255, hydraulic fluid entering third hose 255 passes through third coupling 256, through first coupling 252, through first hose 251, and into first port 48. Eventually, hydraulic fluid will completely fill first port 48 and will begin to enter chamber 130.

As hydraulic fluid enters chamber 130 through first port 48, hydraulic fluid begins to surround punch holder front surface 92 and the front section of punch holder sliding surface 96. It is understood, however, that the area of chamber 130 receiving hydraulic fluid is defined by fourth seal 112 which seals the junction between punch holder sliding surface 96 and chamber inner surface 140 and by second seal 112 which seals the junction between punch free section first end 66 and chamber aperture wall 152 (or bushing inside surface 156 in the relevant embodiment).

As more and more hydraulic fluid is pumped into chamber 130, the pressure within chamber 130 increases. As the pressure within chamber 130 increases, punch holder 90 begins to slide within chamber 130 towards cap inner surface 182 and punch free section first end 66 begins to move within aperture 150 away from outer collar 200. Punch means 60 is thus moving back into the retracted position 11. At first, punch holder 90 will easily slide within chamber 130. This ease of movement will cease, however, once punch holder rear surface 94 touches cap inner surface 182. Punch means 60 is now in the retracted position 11.

As punch holder 90 moves toward cap inner surface 182, the hydraulic fluid which entered through second port 50 when pump 259 was operating in the forward direction is pushed out of chamber 130, through second port 50, through second hose and coupling, 253 and 254, through fourth coupling and hose, 258 and 257, and back into pump 259.

During this time, care must be given to observe the pull pressure gauge 261 of pump 259. Once punch holder rear surface 94 touches cap inner surface 182, the hydraulic pressure reading on pull pressure gauge 261 will increase. The operator must then stop pumping hydraulic fluid into chamber 130.

At this time, the pipe punch apparatus 10 is lifted from pipe 300 and the broken pipe piece is removed from notch 205. Touching the broken pipe piece will reveal that the piece is cold indicating that no heat or friction (or at least an insignificant amount of heat or friction) was generated in creating the hole on pipe 300.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. An apparatus for punching a hole in a pipe, comprising:

a punch housing enclosing a punch mechanism;

said punch housing adaptable for insertion into a pipe;

said punch mechanism capable of being extended from and retracted within said punch housing;

a collar;

connecting means connecting said punch housing and said collar;

said collar receiving said punch mechanism when said punch mechanism is extended from said punch housing;

so that, as said punch mechanism extends from said punch housing to said collar, said punch mechanism gradually extends through said pipe thereby punching a hole in said pipe while generating a minimal amount of friction;

said punch housing including a punch housing top surface, a punch housing outer wall, a punch housing rear portion, and a punch housing front portion;

said punch housing including a cylindrical chamber therein;

said chamber extending through said punch housing outer wall of said punch housing rear portion and partially into said punch housing front portion;

said chamber defined by a chamber front surface and a chamber inner surface; and said punch housing having an aperture extending from said chamber front surface through said punch housing outer wall of said punch housing front portion.

2. An apparatus as in claim 1, wherein:

said punch mechanism comprising a punch;

said punch including a punch free section having a cross-sectional area;

said aperture having a cross-sectional area;

said aperture cross-sectional area being at least slightly larger than said punch free section cross-sectional area;

said punch being slidably disposed within said chamber;

said punch positioned within said chamber so that said punch free section extends into said aperture;

thereby defining a retracted position wherein said punch free section is retracted within said aperture; and thereby defining an extended position wherein said punch free section extends past said housing outer wall of said punch housing front portion and is received by said collar.

3. An apparatus as in claim 2, wherein:

said punch mechanism further comprising a punch holder and a punch attachment mechanism;

said punch further comprising a punch attachment section;

said punch attachment mechanism attaching said punch attachment section to said punch holder; and said punch holder being slidably disposed within said chamber on said chamber inner surface.

4. An apparatus as in claim 3, wherein:

said punch housing further comprising a cap;

said cap selectively sealingly attached to said chamber inner surface;

said cap positioned within said chamber adjacent said outer wall of said punch housing rear portion;

said punch and punch holder positioned within said chamber between said chamber front surface and said cap; and said punch and punch holder being slidably disposed within said chamber between said chamber front surface and said cap.

5. An apparatus as in claim 4, wherein:

said cap including a cap mating surface and a cap attachment mechanism;

said cap attachment mechanism selectively attaching said cap mating surface to said chamber inner surface;

said cap mating surface including a third seal and a third seal groove;

said third seal fitting within said third seal groove and abutting said chamber inner surface; and thereby providing a seal between said cap and said chamber.

6. An apparatus as in claim 5, wherein:

said cap further including a cap inner surface;

said punch and punch holder being slidably disposed within said chamber between said chamber front surface and said cap inner surface;

said punch holder including a punch holder front surface and a punch holder rear surface;

said punch holder rear surface abutting said cap inner surface in said retracted position; and said punch holder front surface abutting said chamber front surface in said extended position.

7. An apparatus as in claim 4, wherein said punch free section being slidably sealingly disposed within said aperture.

8. An apparatus as in claim 7, wherein:

said aperture being defined by a chamber aperture wall;

said aperture being lined with a bushing;

said bushing including a bushing outside surface sealingly connected to said chamber aperture wall;

said bushing inside surface including a second seal and second seal groove;

said second seal fitting within said second seal groove and abutting said punch free section; and thereby providing a seal between said bushing and said punch.

9. An apparatus as in claim 7, wherein:

said punch holder including a punch holder sliding surface;

said punch holder sliding surface abutting and sliding on said chamber inner surface;

said punch holder sliding surface including a fourth seal and a fourth seal groove;

said fourth seal fitting within said fourth seal groove and abutting said chamber inner surface; and thereby providing a seal between said punch holder and said chamber.

10. An apparatus as in claim 9, wherein:

said punch housing including a first port and a second port, each in fluid communication with said chamber;

said first and second ports each extending from said chamber inner surface through said punch housing lop surface;

said first port located vertically adjacent to said chamber front surface;

said second port located vertically adjacent to said cap; and said first and second port in fluid communication with a pump.

11. An apparatus as in claim 10, wherein:

said pump comprising a hydraulic fluid pump;

said pump capable of bi-directional pumping;

said pump in fluid communication with said first and second ports;

thereby causing said punch and punch holder to slide within said chamber into said extended position when said hydraulic fluid is pumped into said second port; and thereby causing said punch and punch holder to slide within said chamber into said retracted position when said hydraulic fluid is pumped into said first port.

12. An apparatus as in claim 7, wherein:

said collar including a collar inner surface and a collar outer surface;

said collar including a notch extending from said collar inner surface towards said collar outer surface at least partially through said collar;

said notch located in the same horizontal plane and the same radial direction as said aperture of said punch housing; and said notch receiving said punch free section when said punch and punch holder are in said extended position.

13. An apparatus as in claim 12, wherein said notch extends from said collar inner surface through said collar outer surface.

14. An apparatus as in claim 12, wherein:

said collar including a die;

said die lining said notch adjacent said collar inner surface;

said die providing said notch with a cross-sectional area; and said notch cross-sectional area being at least slightly larger than said punch free section cross-sectional area.

* * * * *